United States Patent [19]

Fellman et al.

[11] 4,218,292

[45] Aug. 19, 1980

[54] BRIGHT ZINC ELECTROPLATING BATH AND METHOD

[75] Inventors: Jack D. Fellman, Brunswick; Harvey L. Kaufman, Hudson, both of Ohio; Alan W. Stobbe, Mobile, Ala.

[73] Assignee: McGean Chemical Company, Inc., Cleveland, Ohio

[21] Appl. No.: 22,983

[22] Filed: Mar. 22, 1979

[51] Int. Cl.[2] ..... C25D 3/22

[52] U.S. Cl. ..... 204/55 R

[58] Field of Search ..... 204/55 R, 55 Y, 43 Z, 204/114

[56] References Cited

U.S. PATENT DOCUMENTS 2,828,252 3/1958 Fischer ..... 204/55 Y X 3,891,520 6/1975 Todt et al. ..... 204/55 R

*Primary Examiner*—G. L. Kaplan

*Attorney, Agent, or Firm*—Fay & Sharpe

[57] ABSTRACT

An aqueous acidic electroplating bath for the deposition of zinc is provided which comprises zinc ions in an amount sufficient to deposit zinc metal on a substrate, chloride ions in an amount sufficient to impart electrical conductivity to said bath, boric acid in an amount sufficient to buffer said bath to the desired pH, and an effective amount of at least one brightener selected from the group consisting of (i) condensation products of aromatic aldehydes with amides and (ii) condensation products of aromatic aldehydes with urea or substituted ureas.

35 Claims, No Drawings

BRIGHT ZINC ELECTROPLATING BATH AND METHOD

BACKGROUND OF THE INVENTION (a) Field of the Invention

The present invention relates to an improved bright zinc electroplating bath and method which includes the use of (i) condensation products of aromatic aldehydes with amides and (ii) condensation products of aromatic aldehydes with urea or substituted ureas.

(b) Prior Art

Zinc plating from acid solutions has been known in the industry for many years, with applications generally limited to high speed plating, such as strip steel plating. In this application where plating is done at extremely high current densities, only a very narrow bright range is obtainable unless organic brightening agents are employed. The bath commonly contains sulfate ions or is a mixture of sulfate and chloride ions. Deposits from these baths are dull in the mid-to-low current density range and, therefore, are not suitable for decorative applications where low current densities are encountered or complicated by shaped parts which must be bright after plating. Attempts to overcome the deficiencies of sulfate baths with organic brighteners have met little commercial success, since poor throwing power is inherent in the electrolyte itself.

Decorative zinc plating became possible with the introduction of cyanide baths, but such baths had to be operated at a pH greater than 7.0 to prevent the generation of hydrogen cyanide gas. Bright deposits were produced consistently with little attention required for maintenance of the bath as long as the sodium cyanide concentration was maintained above 20–25 grams/liter. Organic addition agents were developed which, in conjunction with the brightening effect of the cyanide ion itself, produced extremely bright deposits from these alkaline solutions.

When consideration of the environment became an integral part of plating operations, the earliest attempts were to run the cyanide baths at lower concentrations. This can be done conveniently to a certain lower limit at which point the brighteners are no longer effective. New additives have been introduced since that time which may employ cyanide concentrations in the bath as low as one gram/liter; however, these baths sacrifice the ease of operation which for so long a period of time was their most significant commercial advantage. Cleaning of parts prior to plating became a critical factor in the successful operation of low cyanide baths. Today, virtually all plating shops must chemically destruct cyanide-containing effluents before they can be discharged. Chemical destruction is an expensive additional cost to a business and its elimination would be desirable.

Recently, non-cyanide alkaline zinc baths have been developed but with only minor success, mainly due to the high susceptibility of the bath to contamination by metals and organics which makes control difficult and the cleaning of parts prior to plating extremely critical.

All alkaline baths have the added disadvantage of low cathode efficiency (in the order of 30–35% in the case of cyanide baths) and great difficulty in plating cast iron parts. Poor cathode efficiencies can not be overcome by any means and the plating of cast iron parts from alkaline baths requires a special "activation" step.

Neutral zinc baths were developed, based on complexing agents to keep the zinc ions in solution at a pH 6.0 to 8.0. These complexing agents make waste treatment, by dilution or by increasing the pH, impossible because the zinc ions are still held in solution. These complexing agents are not specific for zinc but will "tie up" other metal ions in the effluent as well, such as copper or nickel from other operations.

Mildly acidic ammonium chloride baths were introduced which depended on the ammonium ions to complex the zinc. These baths suffer from the same disadvantage in waste treatment, ie., the ammonium ions will complex other metals in the effluent, complicating the treatment process.

A recent innovation in acid zinc plating is non-ammoniated baths which use potassium or sodium ions as substitutes for the ammonium ions. These baths have no complexing agents and waste treatment may easily and economically be done by pH adjustment. The chief limiting factor associated with these processes is the stability of the organic additives used to produce the bright deposits. Common materials employed are aromatic aldehydes and ketones, as described in U.S. Pat. Nos. 3,594,291; 3,694,330; 3,729,394; 3,891,520; and 4,070,256. In each process described, mixtures of surface-active agents and carboxylic acids are employed with aldehydes and ketones. Surface-active agents mentioned most frequently are non-ionic compounds, made by ethoxylating or propoxylating various starting materials, such as nonyl phenol, 2-naphthol, ethylene diamine, ethanol, ethylene glycol, etc. The aldehydes and ketones are slightly soluble oils in aqueous solutions, such as plating baths; therefore, a solvent, miscible with water, is used to dissolve them. Breakdown products from these aldehydes and ketones are even less soluble in aqueous solutions and will float on the surface of the bath as an oil, adhering to racks of parts, which ultimately contaminates the entire system and results in pitted and blotchy deposits. Skimming and filtration are required to eliminate these oils from the bath and it can not be used for production while this cleaning operation is in progress.

A second limitation associated with these processes is that they will produce deposits that are highly stressed and have poor ductility. This is critical in those instances where thicker than normal deposits are required.

A third limitation is the high cost of operation of these processes where expensive solvents are required to keep the brighteners dissolved in the bath. In many cases, a true solution is not achieved, as can be seen by cloudy plating solutions.

A fourth limitation is the narrow temperature range in which these processes must be operated (20°–27° C.). In areas where ambient temperatures approach 32° C., it is very difficult to maintain an operating temperature of 27° C. in the bath, and expensive cooling equipment must be used.

A fifth limitation associated with these processes is the relatively narrow operating range of cathode current density. It is desirable to plate at the highest possible current density so that a shorter plating time can be used to give the desired deposit thickness. Burning occurs at high current densities when the limiting current density of a bath is exceeded. This is accentuated when chemical-conserving baths are used where the zinc ion concentration is as low as 30–35 grams/liter. Ideally, the weakest solution possible to plate a metal satisfactorily is desirable in order to lessen the amount of metal ions lost to the waste treatment system. The limiting current density is not only affected by the concentration of zinc ions but has also been shown to be a function of the types or organic additives employed.

Accordingly, it is the principal object of this invention to provide a zinc acid plating bath which contains organic brighteners which do not suffer from the problems associated with the hereinbefore discussed prior art brightener systems.

It is also an object of this invention to provide a stable non-ammoniated acid zinc bath.

It is further an object of the invention to provide a zinc plating bath containing additives which do not produce insoluble oils as products of electrolysis with prolonged use, thereby eliminating the associated problems and purification procedures.

It is another object of the invention to provide electrodeposits with good brightness, ductility, and stress properties.

It is another object of the invention to provide a zinc plating bath which contains additives which are effective brighteners at all practical current densities and maintain a clear, colorless, zinc plating solution indicative of the fact that the compounds are soluble.

It is another object of the invention to provide a zinc plating bath capable of operating at higher temperatures, such as 27° to 32° C.

It is still another object of the invention to provide a zinc plating bath capable of plating at higher current (faster deposition rate) without producing burned deposits in the higher current density areas.

It is another object of the invention to provide a zinc plating bath which is economical to operate in that a low concentration of zinc ions may be used in making up the bath, which also reduces waste treatment costs.

Still another object of the invention is to provide an improved method for obtaining bright zinc electrodeposits.

Other objects of the invention will become apparent to those skilled in the art from a reading of the following specifications and claims.

SUMMARY OF THE INVENTION

In one aspect the present invention concerns an aqueous acidic electroplating bath for the deposition of zinc which bath comprises zinc ions in an amount sufficient to deposit zinc metal on a substrate; chloride ions in an amount sufficient to impart the desired degree of electrical conductivity to said bath to obtain a bright zinc deposit; boric acid in an amount sufficient to buffer said bath to the desired pH to obtain a bright zinc deposit; and at least one brightener in an amount sufficient to produce a bright zinc deposit, with said brightener being selected from the group consisting of compounds represented by the formulae

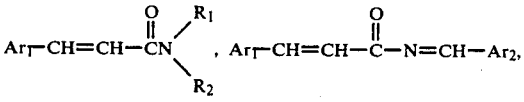

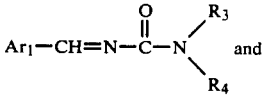

-continued

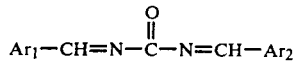

wherein $Ar_1$ and $Ar_2$ are the same or different and are aromatic radicals, including phenyl, naphthyl, 5 and 6 membered hetrocyclic radicals containing nitrogen, oxygen or sulfur atoms in the ring and substituted phenyl, naphthyl and hetrocyclic radicals having at least one substitutent including alkyl, alkoxyl, halogen, haloalkyl, hydroxyl, nitrile and amino; and $R_1$, $R_2$, $R_3$ and $R_4$ are the same or different and include hydrogen, lower alkyl, phenyl, lower alkenyl, lower hydroxyalkyl and hydroxyl.

In another aspect the invention concerns a method of electroplating zinc comprising:

(a) providing an electroplating bath including zinc ions in an amount sufficient to deposit zinc metal on a substrate; chloride ions in an amount sufficient to impart the desired degree of electrical conductivity to said bath; boric acid in an amount sufficient to buffer said bath to the desired pH; and an effective amount of at least one brightener selected from the group consisting of compounds, represented by the formulae

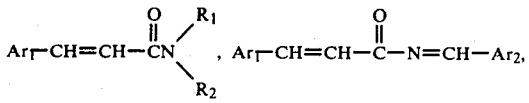

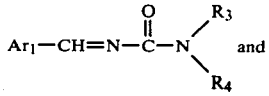

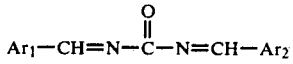

wherein $Ar_1$ and $Ar_2$ are the same or different and are aromatic radicals, including phenyl, naphthyl, 5 and 6 membered hetrocyclic radicals containing nitrogen, oxygen or sulfur atoms in the ring and substituted phenyl, naphthyl and 5 and 6 membered hetrocyclic radicals having at least one substituent including alkyl, alkoxyl, halogen, haloalkyl, hydroxyl, nitrile and amino; and $R_1$, $R_2$, $R_3$ and $R_4$ are the same or different and include hydrogen, lower alkyl, phenyl, lower alkenyl, lower hydroxyalkyl and hydroxyl;

(b) positioning a substrate on which zinc is to be deposited in said bath; and (c) passing electrical current through said bath to deposit bright metallic zinc on said substrate.

In still another aspect, the present invention concerns the use of brightening compounds of the type described together with other additives, such as aromatic carboxylic acids, non-ionic surfactants, and anionic surfactants.

DESCRIPTION OF THE PREFERRED EMBODIMENTS OF THE INVENTION

The practice of the invention will consistently produce bright mirrorlike zinc deposits without any limitation, such as insoluble degradation products of the brightener. The stable compounds are depleted as deposition continues in the bath, but the products formed are soluble in the bath and do not deter from the bright finish of the deposit in any manner. The brighteners are more soluble in the bath than aromatic aldehydes or benzylidene acetone and other similar ketones.

The zinc brighteners used in the practice of the invention can be broadly described as (i) condensation products of aromatic aldehydes with amides and (ii) condensation products of aromatic aldehydes with urea or substituted ureas with more specific characterization dependent on the molar ratio of reactants. Hereinafter, these compounds will be described with reference to the following formulae:

TYPE I:

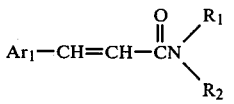

TYPE II:

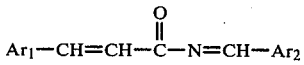

TYPE III:

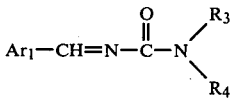

TYPE IV:

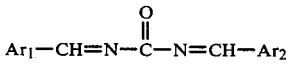

wherein $Ar_1$ and $Ar_2$ are the same or different and are aromatic radicals, including phenyl, naphthyl, 5 and 6 membered heterocyclic radicals containing nitrogen, oxygen or sulfur atoms in the ring and substituted phenyl, naphthyl and hetrocyclic compounds having at least one substituent selected from the group including alkyl, alkoxyl, halogen, haloalkyl, hydroxyl, nitrite and amino; and $R_1$, $R_2$, $R_3$ and $R_4$ are the same or different and include hydrogen, lower alkyl, phenyl, lower alkenyl, lower hydroxyalkyl and hydroxy.

TYPE I:

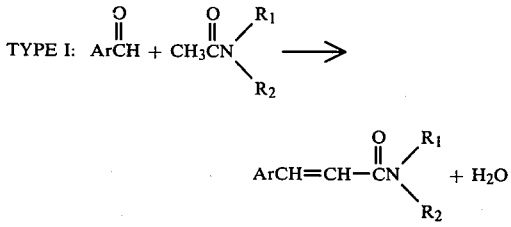

The condensation of equimolar quantities of aryl aldehydes with acetamides produces longer carbon chain unsaturated amides (TYPE I) where the aromatic ring is linked through a double-bond to the carboxyl group. The presence of the amide nirogen atom produces compounds with greater stability and solubility than those where alkyl chains are used. Typical aromatic aldehydes include

TABLE 1 benzaldehyde,
ortho-chlorobenzaldehyde,
para-anisicaldehyde,
para-dimethylaminobenzaldehyde, and
para-hydroxybenzaldehyde which, for the purpose of this disclosure, are illustrative only and not meant to be an exclusive and exhaustive listing. Other aldehydes may also be suitable.

Typical amides include

TABLE 2 acetamide,
dimethylacetamide,
diethylacetamide, and
diphenylacetamide and, again, the list is not meant to be exhaustive but merely illustrative of the broad scope of the invention.

Evidence of reaction to form the products cited is the formation of an insoluble oil from a homogeneous reaction mixture, as the reaction proceeds in a strongly alkaline aqueous-alcoholic solution. Infrared spectra of the products show strong absorbance bands typical of amide carboxyl stretching, the N-H doublet (using acetamide as reactant), the C-H stretch of the double bond carbon-hydrogens and the carbon-carbon stretch of the double bond.

For the purposes of making an additive for acid zinc plating baths, the insoluble reaction product is drawn off and dissolved in water. More concentrated solutions may be obtained with a mixture of a compatible water-miscible solvent, such as ethylene glycol or its alkyl ethers, and water. The proportion of the solvent in water may be from 10% to 50% by weight, depending on the concentration of brightener desired in the additive solution.

TYPE II:

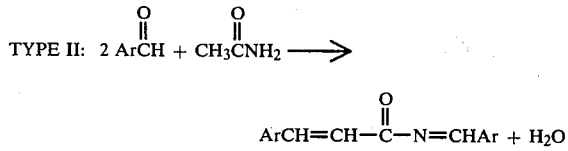

The condensation of two molar equivalents of aryl aldehyde per mole of acetamide produces Schiff Bases of unsaturated amides where a longer conjugated system is created and two aryl groups are able to interact with the carbonyl group. In this unique type of compound, a carbon-nitrogen double bond is formed by the reaction of the second equivalent of aldehyde with the amide nitrogen. Compounds of this type produce exceptional brightness and stability, presumably by the formation of the additional double bond between carbon and nitrogen. This apparently provides additional reactive sites for reduction in the cathode film while zinc is being electrodeposited. Typical aromatic aldehydes include those discussed with respect to TYPE I compounds. For TYPE II compounds, acetamide is the only amide that can be used due to its unique structure of active hydrogens on both the carbon atom and the nitrogen atom which permits the desired reaction to occur.

It is an obvious extension of the invention to use a mixture of two or more aldehydes in the reaction with acetamide, thus forming Schiff Base products with the same or different aryl groups attached.

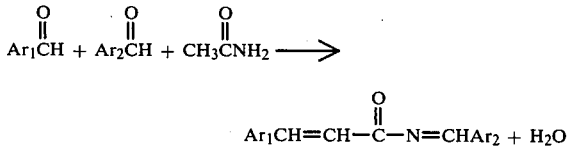

Evidence of reaction to form the products cited is the formation of insoluble oils from homogeneous reaction mixtures as the reaction proceeds. Infrared spectra of the products show absorption bands due to the C=C stretching, C=N stretching, C—O stretching, as well as the absence of the doublet from the nitrogen-hydrogen stretching found in acetamide and TYPE I compounds.

TYPE II additives for zinc plating baths are prepared in the same manner as for TYPE I compounds.

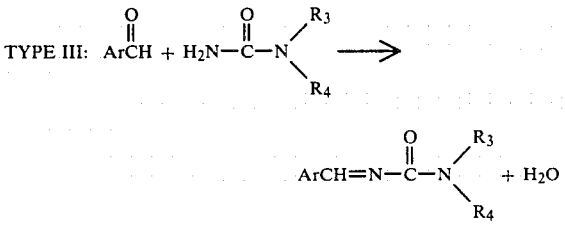

The condensation of equimolar amounts of aryl aldehydes and urea, or substituent ureas, produces novel Schiff Bases in that the >C=N— is attached to the

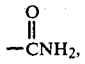

which adds stability and solubility to the molecule. The brightness of zinc deposits, produced from baths containing these compounds is superior to that obtained from baths containing conjugated aromatic ketones having only carbon atoms in the chain. The added electron density, from the substituent of nitrogen atoms for carbon atoms, appears to improve the over-all brightness of the deposit. Typical aldehydes used in TYPE III reactions have been mentioned above with respect to TYPE I compounds.

Evidence of reaction to form the products cited is the formation of insolubles oils from homogeneous reaction mixtures as the reaction proceeds. The products crystallize if allowed to stand overnight. Additives for zinc plating baths, using TYPE III compounds, can be made up as described for TYPE I compounds.

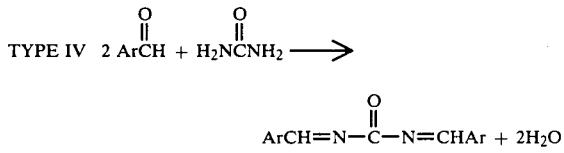

The condensation of 2 molar equivalents of aryl aldehydes per mole of urea produces symmetrical molecules containing two Schiff Base linkages. These compounds are very effective zinc brighteners and brighter deposits are obtained using these as additives to zinc baths than when compounds of the type used by the prior art are employed. The improvement is attributed to the electron density of the conjugated system involving two carbon-nitrogen double bonds, a carbon-oxygen double bond, and two aryl compounds. Typical aldehydes, used for TYPE IV reactions, are similar to those employed to produce TYPE I compounds.

It is obviously an extension of the invention to use a mixture of two or more aldehydes for the reaction with urea, thus forming Schiff Base products with the same or different aryl groups attached.

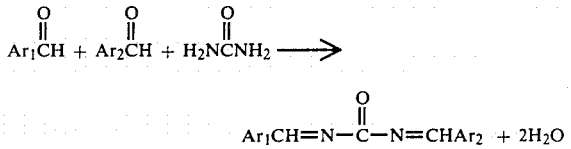

Evidence of reaction to form the product cited is the formation of insoluble oils from homogeneous reaction mixtures as the reaction proceeds. The oils crystallize upon standing overnight. Additives for zinc plating baths, using TYPE IV compounds, can be made up as described for TYPE I compounds.

In general, the zinc brighteners of the instant invention produce unexpected results in that brighter deposits are obtained with their use over those of prior art and no insoluble degradation products are formed with prolonged operation, as is now common in commercial plating operations. Concentrated solutions may easily be prepared for adding the compounds to a plating bath.

The mechanism for these unexpected results is not known, since the compounds of the invention have not been used in plating baths before. References to these compounds have not been found in the literature which indicates that other workers have not considered them as brighteners or investigated their manner of performance. The brightening ability of other additives, common to the prior art, has been reported but no references have been found which reveal the mechanism taking place in the production of bright zinc deposits.

A possible explanation is that the substitution of nitrogen atoms for carbon atoms in compounds currently being commercially employed produces molecules of greater activity and stability in the plating bath. The improvement starts with the substitution of one nitrogen atom for a carbon atom in TYPE I compounds, through the substitution of two nitrogen atoms for two carbon atoms in TYPE III compounds. The 2-molar aldehyde reaction products of TYPES II and IV extend the nitrogen substitution and include the formation of a second double bond in conjugation with the system.

In the practice of the invention all that is required is that an effective amount of brightener be employed. As used herein the term "effective amount" means the amount of brightener necessary to give plating results which are superior to those obtained when no such brightener is employed. In use it has been determined the brightener should preferably be utilized in an amount ranging from about 0.05 to about 5 grams/liter of plating solution.

An acid zinc bath, in which the cited compounds are effective brightening agents, consists of zinc ions, chloride ions, and boric acid. They function through synergism to produce full zinc deposits over a broad current density range. In some instances, the leveling and brightness of these zinc deposits rival that obtained from nickel-chromium plating. Some installations may now, in fact, be able to substitute zinc plating for the more expensive nickel-chromium plating, since the appearance of parts will be virtually equivalent. Other additives, commonly employed by the prior art and which may be used in conjunction with the compounds of this invention, are aromatic carboxylic acids, nonionic surfactants, and anionic surfactants.

Zinc ions are commonly supplied to the plating bath by the addition of zinc oxide or a zinc salt, such as the chloride, sulfate, or fluoborate and concentrations as low as about 10 grams/liter may be used in order to minimize chemical costs. Processes using additives common to the prior art have a tendency to produce coarse, grainy, dark deposits in the higher current density region when low metal concentrations are used, severely limiting the useful plating current density range. The compounds of this invention may be used in dilute zinc solutions, such as about 10 grams/liter, and not produce these effects. This is a decided advantage over prior art systems. The upper limit for zinc ion concentration is governed by economics. Concentrations as high as 100 grams/liter may be used, but the chemical cost would be greater and there is no advantage in doing so.

As above noted, chloride ions must be present in the plating bath of the invention to obtain the desired results. In practice, it has been found that the chloride ion concentration of the bath should range from about 5 to about 150 grams per liter of plating solution.

Additional materials may be added to increase the conductivity of the zinc bath, which allows the plating to be carried out at lower voltages. This further improves the economics of the process. Typical salts used for this purpose are sodium sulfate, sodium chloride, sodium fluoborate, ammonium chloride, ammonium sulfate, magnesium chloride, potassium sulfate, and potassium chloride to name a few. Until most recently, ammonium chloride was used due to its low cost and availability. However, with the recent demands on the treatment of effluents, ammonium ions are undesirable as they complex other metals, such as copper and nickel, which are commonly found in effluents from plating shops, thereby retarding their precipitation and removal. Potassium chloride is the preferred material for this invention as it will not affect effluent-treatment systems and the chloride ion provides greater conductivity. Concentrations as low as 25 grams/liter may be employed but optimum plating results and conductivity are achieved by the use of higher concentrations such as 200 to 225 grams/liter.

Boric acid is added to the bath to maintain its pH at the desired level. In practice concentrations of 4 to 40 grams/liter are employed to act as a buffer and control the pH of the plating bath. Boric acid also aids in producing bright deposits and preventing the formation of pitted deposits.

The pH of the plating bath should be controlled and maintained in the range of about 3.0 to 6.5. The preferred operating range is from 4.5–5.8, with 5.0–5.5 being the optimum.

Zinc anodes utilized in the practice of the invention should be fabricated from high purity zinc. Heavy metal contaminants, such as copper, lead, and cadmium codeposit with the zinc and adversely affect the performance of the brighteners.

The bath temperature should be maintained within the range of about 20° to 40° C., with 24° to 28° C. being preferred. Higher temperatures than recommended will tend to produce deposits that are less than fully bright, the extent being dependent upon the temperature.

Other additives which can be used in the practice of the invention that are helpful in producing full bright deposits include aromatic carboxylic acids, such as benzoic, ortho-hydroxybenzoic, para-hydroxybenzoic, cinnamic and nicotinic acids, used from a minimum concentration of 0.1 gram/liter to saturation. However, best results are achieved when the concentration ranges from about 0.5 gram/liter to about 5.0 grams/liter.

Effective non-ionic surfactants which can be used in practice of the invention include various commonly known ethoxylated or propoxylated derivatives. These compounds are generally referred to as non-ionic polyoxyalkylated compounds. Subtle differences, such as ratio or chain length of ethoxylation of the same substrate, will influence the performance of the surfactant in the plating bath. Those derivatives found to be compatible with the compounds of the invention are shown in Table 1. The list is not meant to be exhaustive or definitive, but merely to show the broad scope of additives which are compatible with the system of the present invention. The non-ionic surfactant should be used in an amount ranging from about 1 to about 30 grams/liter of plating solution.

TABLE 3

NON-IONIC SURFACTANTS

Alkoxylated Derivatives of:
- Propylene glycol
- Ethylene glycol
- Ethylene diamine
- Nonyl phenol
- 2,4,7,9-Tetramethyl-5-decyne-4,7-diol Effective anionic surfactants which can be used in the practice of the invention include the alkali metal or ammonium salts of the sulfate esters of various alkoxylated compounds commonly known to the state of the art. Subtle differences in the number of alkoxide groups per mole of the reactant will influence the performance of the surfactant in the plating bath. Those derivatives found to be compatible with the compounds of the invention are shown in Table 2. The list is merely to demonstrate examples and is not meant to be restrictive. Anionic surfactants should preferably be used in an amount ranging from about 1 to about 30 grams/liter of plating solution.

TABLE 4

ANIONIC SURFACTANTS

Sulfate esters of alkoxylated derivatives of:

| | |
|---|---|
| $CH_3(CH_2)_nO$ | Linear primary alcohols |
| 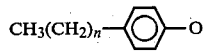 | Alkyl-substituted phenols |

where n is an integer from 1 to 15.

The following stock solution was prepared and used to demonstrate the practice of the invention:

| | |
|---|---|
| Zinc Chloride | 70 grams/liter |
| Potassium Chloride | 225 grams/liter |
| Boric Acid | 30 grams/liter |
| pH | 5.3 |
| Temperature | 20°–28° C. |
| Agitation | Cathode rod |

TEST METHOD UTILIZED

In the following examples, two hundred sixty (260) ml of the above stock solution are added to a 267 ml Hull Cell and the respective brightener additions made. A 2¾" by 4" steel test panel was cleaned, placed in the cell, and plated at 2 amps for 5 minutes.

EXAMPLE I

A test panel, plated in the stock solution with no additives, was black and powdery from the HCD (high current density) edge to the LCD (low current density) edge.

EXAMPLE II

A quantity of 0.2 gram/liter of the equimolar condensation product of benzaldehyde and acetamide (TYPE I compound) was added to the stock solution. The deposit was semi-bright and reflective from 0–20 ASF (amperes per square foot) dull from 20–50 ASF, and burned from 50–HCD edge. This low current density brightness is a significant improvement over the panel from Example I.

EXAMPLE III

A quantity of 2.0 grams/liter of potassium benzoate was added to the above-described stock solution. The deposit from this bath was dull, but had some grain refinement, as compared to Example I.

EXAMPLE IV

A quantity of 4.0 grams/liter of ethoxylated 2,4,7,9-tetramethyl-5-decyne-4,7-diol was added to the stock solution and the panel from this bath was dull from the HCD edge to the LCD edge, very much like that obtained from the stock solution with no additives.

EXAMPLE V

A quantity of 4.0 grams/liter of ethoxylated 2,4,7,9-tetramethyl-5-decyne-4,7-diol was added to the solution of Example II, and the deposit produced was bright from 0–20 ASF, dull from 20–80 ASF, and burned from 80 ASF to the HCD edge.

EXAMPLE VI

A quantity of 2.0 grams/liter of potassium benzoate was added to the solution of Example V and the deposit now was bright from 0–60 ASF, dull from 60–90 ASF, and burned from 90–HCD edge.

EXAMPLE VII

A quantity of 0.8 gram/liter of an ethoxylated primary alcohol sulfate was added to the bath of Example VI and the bright range was extended across the entire panel, which corresponds to a current density range of from 0 to over 100 ASF. There is no HCD burning on the panel which is a significant improvement over the prior art.

This series of panels, from Example I through Example VII, demonstrates the synergistic effect between the four basic components of the preferred brightener system to produce full bright zinc deposits. When these are all utilized in combination, mirror-bright zinc deposit is obtained.

Bright deposits may be achieved by various combinations of additives listed in Tables 1, 2, 3, and 4, as shown in the following examples.

EXAMPLE VIII

Alkoxylated ethylene diamine (Tetronic 704): 5.0 g/l
Ethoxylated primary alcohol sulfate: 1.0 g/l
Potassium benzoate: 1.5 g/l
2:1 Reaction product of para-anisaldehyde and acetamide: 0.25 g/l
The deposit was bright from 0–100 ASF, and dull from 100–HCD edge.

EXAMPLE XI

Alkoxylated ethylene glycol (Carboxwax 4000): 5.0 g/l
Ethoxylated primary alcohol sulfate: 1.0 g/l
Potassium ortho-hydroxybenzoate: 1.0 g/l
2:1 Reaction product of benzaldehyde and acetamide: 0.25 g/l
The deposit was bright from 0 to over 100 ASF, and dull from over 100 ASF to HCD edge.

EXAMPLE XII

Ethoxylated 2,4,7,9-tetramethyl-5-decyne-4,7-diol 4.5 g/l
Ethoxylated primary alcohol sulfate: 0.8 g/l
Potassium nicotinate 0.5 g/l
Potassium Benzoate 1.0 g/l
1:1 Reaction product of ortho-chlorobenzaldehyde and acetamide: 0.2 g/l
The deposit was bright from 0–100 ASF, and dull from 100–HCD edge.

EXAMPLE XIII

Ethoxylated 2,4,7,9-tetramethyl-5-decyne-4,7-diol 5.0 g/l
Ethoxylated aliphatic alcohol sulfate 1.0 g/l
Potassium cinnamate 0.5 g/l
1:1 Reaction product of benzaldehyde and N,N-dimethylacetamide: 0.15 g/l
The resultant deposit was exceptionally bright.

While there have been described what are at present considered to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. An aqueous acidic electroplating bath for the deposition of zinc which bath comprises zinc ions in an amount sufficient to deposit zinc metal on a substrate; chloride ions in an amount sufficient to impart the desired degree of electrical conductivity to said bath to obtain a bright zinc deposit; boric acid in an amount sufficient to buffer said bath to the desired pH to obtain a bright zinc deposit; and at least one brightener in an amount sufficient to obtain a bright zinc deposit, said brightener being selected from the group consisting of compounds represented by the formulae:

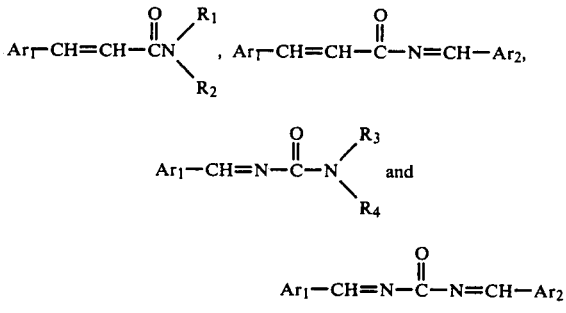

wherein $Ar_1$ and $Ar_2$ are the same or different and are aromatic radicals, including phenyl, naphthyl, 5 and 6 membered heterocyclic compounds containing nitrogen, oxygen or sulfur atoms in the rings and substituted phenyl, naphthyl and heterocyclic compounds having at least one substituent including alkyl, alkoxyl, halogen, haloalkyl, hydroxyl, nitrile and amino; and $R_1$, $R_2$, $R_3$ and $R_4$ are the same or different and include hydrogen, lower alkyl, phenyl, lower alkenyl, lower hydroxyalkyl and hydroxy.

2. The electroplating bath of claim 1 wherein said brightener is present in an amount ranging from about 0.05 to about 5 grams per liter.

3. The electroplating bath of claim 1 wherein said zinc ions are present in an amount ranging from about 10 to about 100 grams per liter; said chloride ions are present in an amount ranging from about 5 to about 150 grams per liter; and said boric acid is present in an amount ranging from about 1 to about 50 grams per liter.

4. The electroplating bath of claim 3 wherein said boric acid is present in an amount ranging from about 4 to about 40 grams per liter.

5. The electroplating bath of claim 1 having a pH ranging from about 3.0 to about 6.5.

6. The electroplating bath of claim 5 wherein said pH ranges from about 4.5 to about 5.8.

7. The electroplating bath of claim 6 wherein said pH ranges from about 5.0 to about 5.5.

8. The electroplating bath of claim 1 which is further characterized by containing an effective amount of at least one non-ionic surfactant compound.

9. The electroplating bath of claim 8 wherein said non-ionic surfactant compound is present in an amount ranging from about 1 to about 30 grams per liter.

10. The electroplating bath of claim 8 wherein said non-ionic surfactant compound is selected from the group consisting of alkoxylated derivatives of propylene glycol, ethylene glycol, ethylene diamine, nonyl phenol, and 2,4,7,9-tetramethyl-5-decyne-4,7-diol.

11. The electroplating bath of claim 1 which is further characterized by containing an effective amount of at least one anionic surfactant.

12. The electroplating bath of claim 11 wherein said anionic surfactant is present in an amount ranging from about 1 to about 30 grams per liter.

13. The electroplating bath of claim 11 wherein said anionic surfactant is selected from the group consisting of sulfated esters of alkoxylated derivatives of linear primary alcohols and alkyl-substituted phenols.

14. The electroplating bath of claim 1 which is further characterized by containing at least one carboxylic acid as an additional brightener.

15. The electroplating bath of claim 14 wherein said carboxylic acid is present in an amount ranging from about 0.1 grams per liter to saturation.

16. The electroplating bath of claim 1 which is further characterized by containing from about 0.1 to about 25 grams per liter of ethoxylated 2,4,7,9-tetramethyl-5-decyne-4,7-diol; from about 0.1 to about 25 grams per liter of ethoxylated primary alcohol sulfate, from about 0.1 to about 15 grams per liter of potassium benzoate; from about 0.1 to about 15 grams per liter of potassium nicotinate; and from about 0.5 to about 5 grams per liter of the condensation product of orthochlorobenzaldehyde and acetamide.

17. A method of electroplating bright zinc comprising:

(a) providing an acidic electroplating bath including zinc ions in an amount sufficient to deposit zinc metal on a substrate; chloride ions to impart the desired degree of electrical conductivity to said bath to obtain a bright zinc deposit; boric acid in an amount sufficient to buffer said bath to the desired pH to obtain a bright zinc deposit; and at least one brightener in an amount sufficient to obtain a bright zinc deposit, said brightener being selected from the group consisting of compounds represented by the formulae:

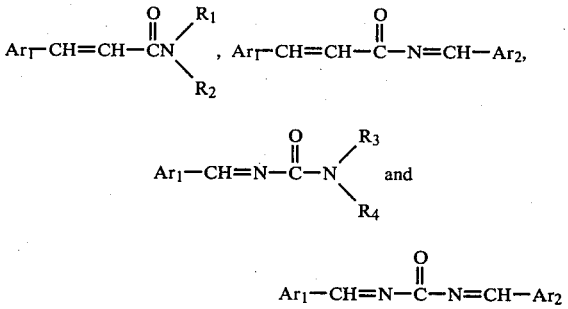

wherein $Ar_1$ and $Ar_2$ are the same or different and are aromatic radicals including phenyl, naphthyl, 5 and 6 membered heterocyclic compounds containing nitrogen, oxygen or sulfur atoms in the rings and substituted phenyl, naphthyl and heterocyclic compounds having at least one substituent including alkyl, alkoxyl, halogen, haloalkyl, hydroxyl, nitrile and amino; and $R_1$, $R_2$, $R_3$ and $R_4$ are the same or different and include hydrogen, lower alkyl, phenyl, lower alkenyl, lower hydroxyalkyl and hydroxy;

(b) positioning a substrate on which zinc is to be deposited in said bath; and (c) passing electrical current through said bath to deposit metallic zinc on said substrate.

18. The method of claim 17 where said brightener is present in an amount ranging from about 0.05 to about 5 grams per liter.

19. The method of claim 17 wherein said zinc ion is present in an amount ranging from about 10 to about 100 grams per liter; said chloride ion is present in an amount ranging from about 5 to about 150 grams per liter; and said boric acid is present in an amount ranging from about 1 to about 50 grams per liter.

20. The method of claim 19 wherein said boric acid is present in an amount ranging from about 4 to about 40 grams per liter.

21. The method of claim 17 wherein said bath has a pH ranging from about 3.0 to about 6.5.

22. The method of claim 21 wherein said pH ranges from about 4.5 to about 5.8.

23. The method of claim 22 wherein said pH ranges from about 5.0 to about 5.5.

24. The method of claim 17 wherein said bath is further characterized by containing an effective amount of at least one non-ionic surfactant compound.

25. The method of claim 24 wherein said non-ionic surfactant compound is present in an amount ranging from about 1 to about 30 grams per liter.

26. The method of claim 24 wherein said non-ionic surfactant compound is selected from the group consisting of alkoxylated derivatives of propylene glycol, ethylene glycol, ethylene diamine, nonyl phenol, and 2,4,7,9-tetramethyl-5-decyne-4,7-diol.

27. The method of claim 17 wherein said bath is further characterized by containing an effective amount of at least one anionic surfactant.

28. The method of claim 27 wherein said anionic surfactant is present in an amount ranging from about 1 to about 30 grams per liter.

29. The method of claim 27 wherein said anionic surfactant is selected from the group consisting of sulfated esters of alkoxylated derivatives of linear primary alcohols and alkyl-substituted phenols.

30. The method of claim 17 wherein said bath is further characterized by containing at least one carboxylic acid as an additional brightener.

31. The method of claim 30 wherein said carboxylic acid is present in an amount ranging from about 0.1 grams per liter to saturation.

32. The method of claim 17 wherein said bath is further characterized by containing from about 0.1 to about 25 grams per liter of ethoxylated 2,4,7,9-tetramethyl-5-decyne-4,7-diol; from about 0.1 to about 25 grams per liter of ethoxylated primary alcohol sulfate; from about 0.1 to about 15 grams per liter of potassium benzoate; from about 0.1 to about 15 grams per liter of potassium nicotinate; and from about 0.5 to about 5 grams per liter of the condensation product of orthochlorobenzaldehyde and acetamide.

33. The method of claim 17 wherein said electroplating bath is maintained at a temperature ranging from about 20° to about 40° C.

34. The method of claim 33 wherein said bath is maintained at a temperature ranging from about 24° to about 28° C.

35. The method of claim 17 which is further characterized by having added to said electroplating bath from about 25 to about 225 grams/liter of potassium chloride.

* * * * *